US011639842B2

(12) United States Patent
El Bey

(10) Patent No.: US 11,639,842 B2
(45) Date of Patent: May 2, 2023

(54) PERSONAL DEFENSE DEVICE

(71) Applicant: Kenaniah El Bey, Kannapolis, NC (US)

(72) Inventor: Kenaniah El Bey, Kannapolis, NC (US)

( * ) Notice: Subject to any disclaimer, the term of this patent is extended or adjusted under 35 U.S.C. 154(b) by 0 days.

(21) Appl. No.: 17/412,390

(22) Filed: Aug. 26, 2021

(65) Prior Publication Data

US 2023/0060233 A1 Mar. 2, 2023

(51) Int. Cl.
*F41H 9/10* (2006.01)

(52) U.S. Cl.
CPC ..... *F41H 9/10* (2013.01)

(58) Field of Classification Search
CPC ..... F41H 9/10; F41A 17/066
See application file for complete search history.

(56) References Cited

U.S. PATENT DOCUMENTS 2,109,589 A * 3/1938 Horwitt ..... B05B 11/3011 239/375
2,629,516 A * 2/1953 Badham ..... B05B 9/0838 222/113
3,730,390 A * 5/1973 Adrian ..... F41H 9/10 222/79
3,841,526 A * 10/1974 Haskins ..... F41H 9/10 222/79
4,186,851 A * 2/1980 Cantor ..... F41H 9/10 222/113
4,843,336 A * 6/1989 Kuo ..... F41H 13/0087 340/521
5,397,029 A * 3/1995 West ..... B65D 83/386 222/509
5,409,638 A * 4/1995 Battochi ..... F41H 13/0037 252/514
D363,107 S 10/1995 Sanford
5,629,679 A * 5/1997 Cranford ..... F41H 9/10 340/693.8
6,196,419 B1 * 3/2001 Haney ..... F41H 9/10 222/325
6,237,461 B1 * 5/2001 Poole ..... F41H 9/10 222/1
7,152,990 B2 * 12/2006 Kukuk ..... F41B 15/04 222/113

(Continued)

FOREIGN PATENT DOCUMENTS

WO WO9740332 10/1997

*Primary Examiner* — Joshua E Freeman

(57) ABSTRACT

A personal defense device for projecting a lachrymator agent includes an L-shaped housing, which defines a barrel and a grip. A valve is positioned in the barrel proximate to the grip, which extends from a first end of the barrel. A channel extends from the valve to a second end of the barrel. A cavity extends into the grip and is in fluidic communication with the valve. The grip selectively engages a cannister, which contains a lachrymator agent, that is inserted into the cavity. The cannister is removably engaged to the L-shaped housing and an outlet of the cannister is operationally engaged to the valve. A trigger is engaged to the L-shaped housing and operationally engaged to the valve can be triggered to actuate the valve. The lachrymator agent is dispensed from the cannister through the channel toward a target that is in substantial alignment with the barrel.

11 Claims, 5 Drawing Sheets

FIG. 4

(56) References Cited

U.S. PATENT DOCUMENTS

| | | | | |
|---|---|---|---|---|
| 7,614,526 | B2 * | 11/2009 | Gaillen | B65D 83/386 604/207 |
| 8,985,397 | B2 * | 3/2015 | Lord | F41H 9/10 222/402.1 |
| 9,605,930 | B2 * | 3/2017 | Ben Yair | F41H 9/10 |
| 10,254,089 | B2 * | 4/2019 | Gosson | F41B 9/0087 |
| 10,823,381 | B1 * | 11/2020 | Wu | F21L 4/00 |
| 10,835,913 | B2 * | 11/2020 | Mispel-Beyer | B05B 1/06 |
| 2007/0086190 | A1 * | 4/2007 | Kukuk | F41C 23/10 362/253 |
| 2012/0118990 | A1 * | 5/2012 | Beever, III | F41B 9/0025 239/71 |
| 2014/0252028 | A1 * | 9/2014 | Lord | G08B 21/02 222/162 |
| 2014/0263445 | A1 * | 9/2014 | Rowlett | F41H 9/10 222/113 |
| 2016/0091267 | A1 * | 3/2016 | Mascorro | F41A 17/066 42/70.11 |
| 2016/0265868 | A1 * | 9/2016 | Forsythe | F41A 17/38 |
| 2016/0313095 | A1 * | 10/2016 | Gosson | F41B 9/0071 |
| 2017/0108310 | A1 * | 4/2017 | Zimmerman | F41A 19/18 |
| 2018/0347952 | A1 * | 12/2018 | Hong | G06V 40/1306 |
| 2020/0256650 | A1 * | 8/2020 | Sylver | F41A 17/063 |
| 2021/0185138 | A1 * | 6/2021 | Gant | F41A 17/063 |

* cited by examiner

PERSONAL DEFENSE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to personal defense devices and more particularly pertains to a new personal defense device for projecting a lachrymator agent. The present invention discloses a pistol shaped device which can dispense a lachrymator agent onto a target, and which incorporates a flashlight and a fingerprint actuated trigger.

(2) Description of Related Art Including Information Disclosed Under 37 CFR 1.97 and 1.98

The prior art relates to personal defense devices, and in particular defense devices that project a lachrymator agent, such as pepper spray. Such prior art defense devices include pistol shaped devices which can dispense a lachrymator agent onto a target. What is lacking in the prior art is a personal defense device that is pistol shaped, incorporates a flashlight and a fingerprint actuated trigger, and which can dispense a lachrymator agent onto a target.

BRIEF SUMMARY OF THE INVENTION

An embodiment of the disclosure meets the needs presented above by generally comprising an L-shaped housing, which defines a barrel and a grip. The grip extends from a first end of the barrel. A valve is positioned in the barrel proximate to the grip. A channel extends from the valve to a second end of the barrel. A cavity extends into the grip so that the cavity is in fluidic communication with the valve. The grip is configured to selectively engage a cannister, which contains a lachrymator agent, that is inserted into the cavity so that the cannister is removably engaged to the L-shaped housing. An outlet of the cannister is operationally engaged to the valve. A trigger is engaged to the L-shaped housing and is operationally engaged to the valve. The trigger is configured to be triggered to selectively actuate the valve. The lachrymator agent is dispensed under pressure from the cannister through the channel toward a target that is in substantial alignment with the barrel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
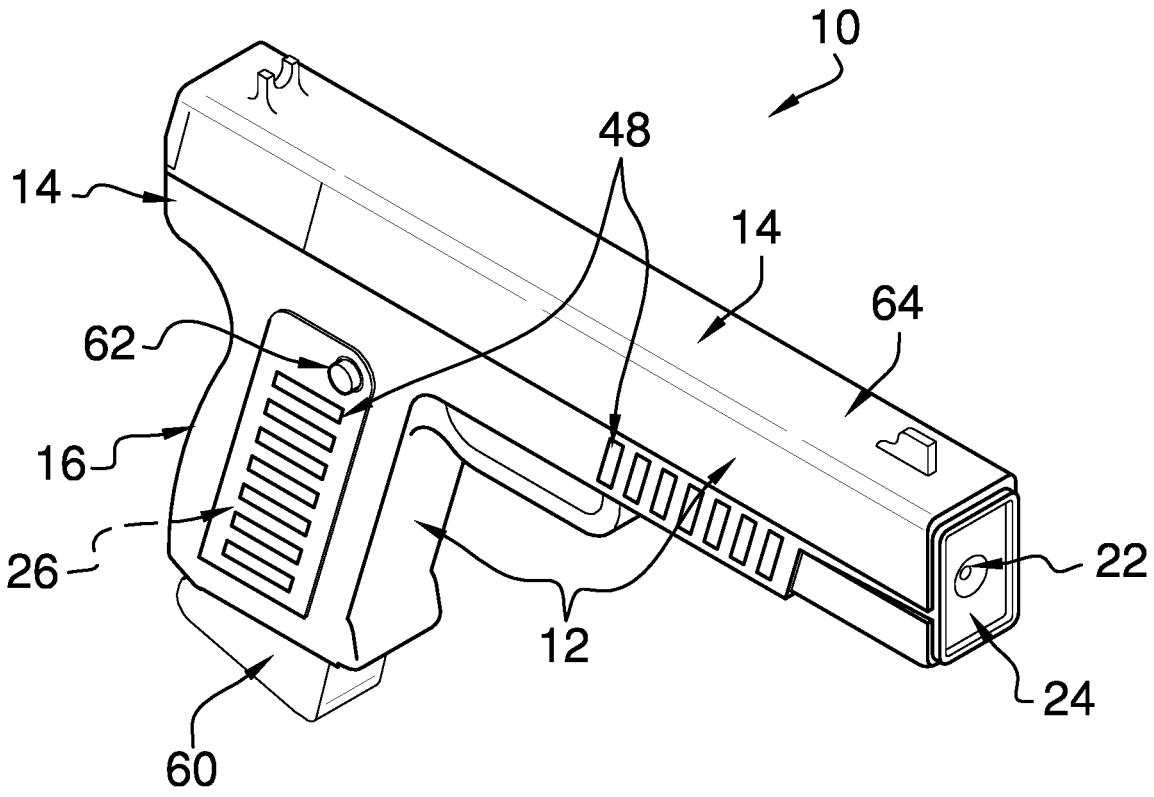
FIG. 1 is an isometric perspective view of a personal defense device according to an embodiment of the disclosure.

With reference now to the drawings, and in particular to FIGS. 1 through 5 thereof, a new personal defense device embodying the principles and concepts of an embodiment of the disclosure and generally designated by the reference numeral 10 will be described.

As best illustrated in FIGS. 1 through 5, the personal defense device 10 generally comprises an L-shaped housing 12, which defines a barrel 14 and a grip 16. The grip 16 extends from a first end 18 of the barrel 14. A valve 20 is positioned in the barrel 14 proximate to the grip 16. A channel 22 extends from the valve 20 to a second end 24 of the barrel 14. A cavity 26 extends into the grip 16 so that the cavity 26 is in fluidic communication with the valve 20. The grip 16 is configured to selectively engage a cannister 28, which contains a lachrymator agent 30, that is inserted into the cavity 26 so that the cannister 28 is removably engaged to the L-shaped housing 12. The lachrymator agent 30 may comprise pepper spray, nonivamide, 2-chlorobenzylidene malononitrile, dibenzoxazepine, phenacyl chloride, bromoacetone, xylyl bromide, and the like.

An outlet 32 of the cannister 28 is operationally engaged to the valve 20. A trigger 34 is engaged to the L-shaped housing 12 and is operationally engaged to the valve 20. The trigger 34 is configured to be triggered to selectively actuate the valve 20. The lachrymator agent 30 is dispensed under pressure from the cannister 28 through the channel 22 toward a target that is in substantial alignment with the barrel 14.

A battery 36 and a microprocessor 38 are positioned in the barrel 14. The microprocessor 38 is operationally engaged to the battery 36 and the valve 20. A trigger lock 40 is engaged to the L-shaped housing 12 and is operationally engaged to the microprocessor 38 and the trigger 34. The trigger lock 40 is positioned to selectively lock the trigger 34. Mechanisms for locking triggers are known to those skilled in the art of trigger locks and may comprise latches, linear actuators, and the like.

A fingerprint sensor 42 is engaged to the trigger 34 is operationally engaged to the microprocessor 38. The fingerprint sensor 42 is configured to authenticate a fingerprint of a user, positioning the fingerprint sensor 42 to signal the microprocessor 38 to actuate the trigger lock 40 to unlock the trigger 34.

Figure 5:
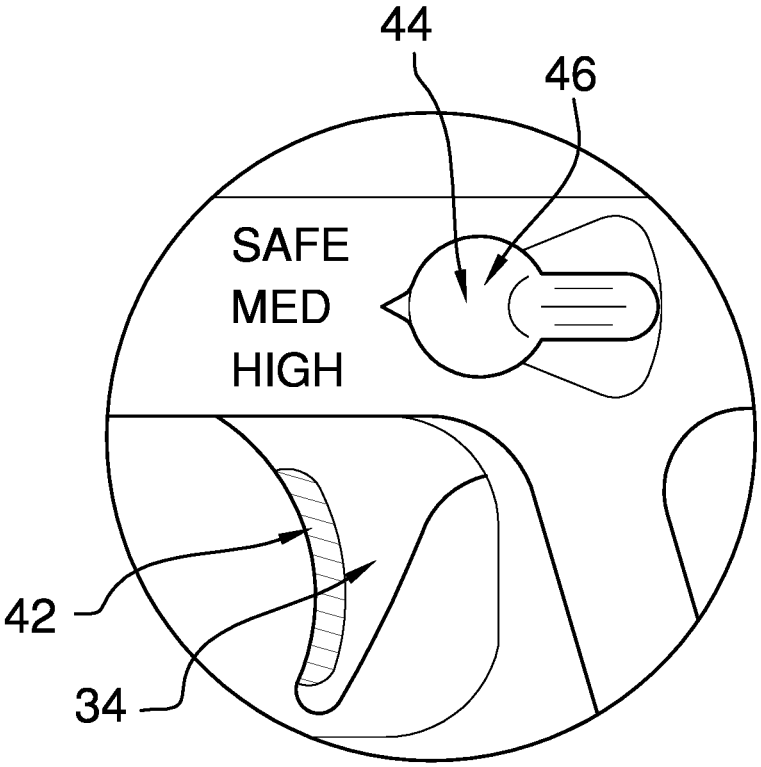
FIG. 5 is a detail view of an embodiment of the disclosure.

A selector 44 is engaged to the barrel 14 and is operationally engaged to the microprocessor 38. The selector 44 is configured to be manipulated by the user to signal the microprocessor 38 to enable the fingerprint sensor 42 and to set the valve 20 to allow a respective flow rate from the cannister 28. For example, as shown in FIG. 5, a dial 46 can be selectively positioned in a safe setting, wherein the fingerprint sensor 42 is deactivated, a medium setting, wherein the fingerprint sensor 42 is actuated and the valve 20 is set for a medium flow rate, and a high setting, wherein the fingerprint sensor 42 is actuated and the valve 20 is set for a high flow rate.

Figure 2:
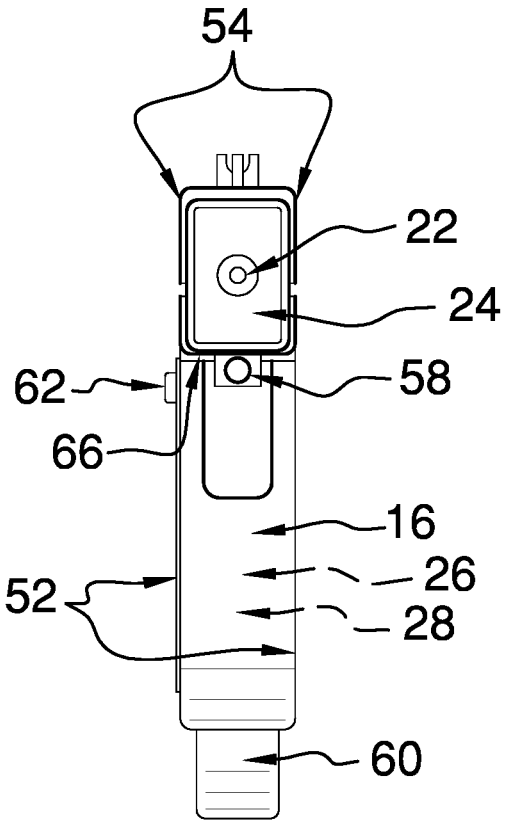
FIG. 2 is a front view of an embodiment of the disclosure.
Figure 3:
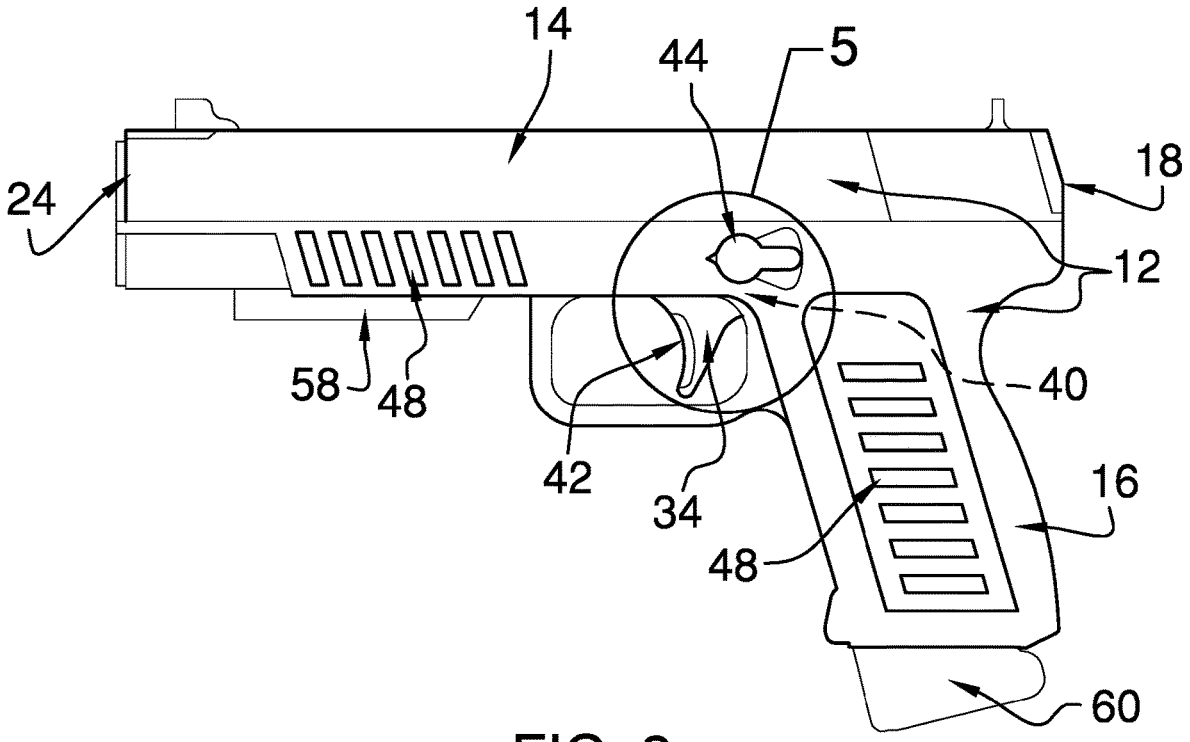
FIG. 3 is a side view of an embodiment of the disclosure.
Figure 4:
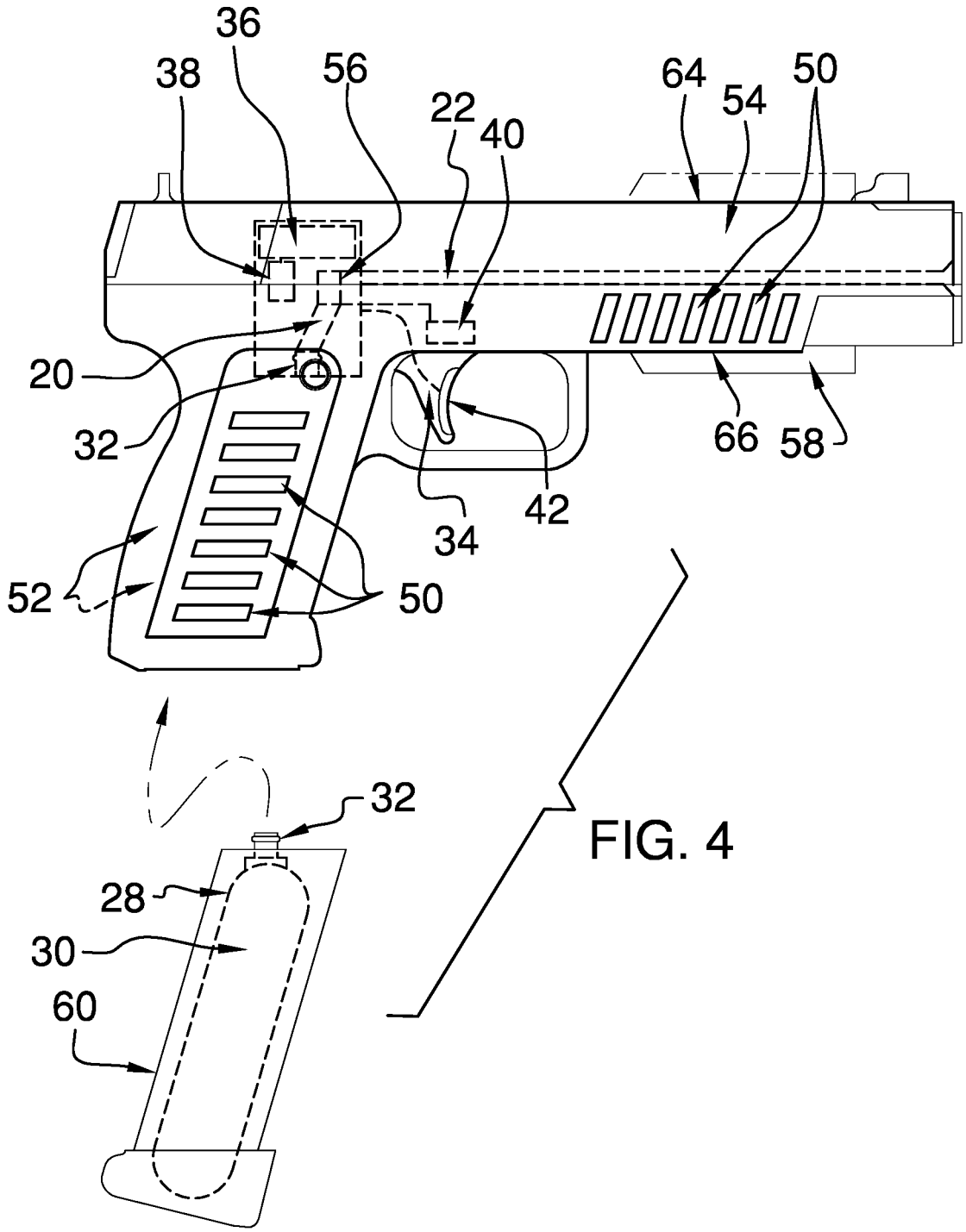
FIG. 4 is a side view of an embodiment of the disclosure.

An indicator 48 is engaged to the L-shaped housing 12 and is operationally engaged to the microprocessor 38. The indicator 48 may comprise a plurality of light emitting diodes 50, which is positioned on opposed faces 52 of the grip 16 and opposed sides 54 of the barrel 14, as shown in FIGS. 2 and 3, or other indicating means, such as, but not limited to, dials, electronic displays, and the like.

A flow sensor 56 is operationally engaged to the valve 20 and is operationally engaged to the microprocessor 38. The flow sensor 56 is configured to measure a flow of the lachrymator agent 30 through the valve 20 and to communicate volumetric readings to the microprocessor 38. The microprocessor 38 is positioned to actuate the indicator 48 to display a volume of lachrymator agent 30 remaining in the cannister 28.

A flashlight 58 is engaged to the barrel 14 and is operationally engaged to the trigger 34. The trigger 34 is positioned to selectively actuate the flashlight 58 to project light past the second end 24 of the barrel 14. The flashlight 58 is configured to selectively illuminate the target. The flashlight 58 can be positioned on a top 64, a bottom 66 or a respective opposed side 54 of the barrel 14.

The personal defense device 10 also may comprise a magazine 60, which is configured for insertion of the cannister 28. The magazine 60 is selectively insertable into the cavity 26 so that the magazine 60 is removably engaged to the L-shaped housing 12. A release button 62 is engaged to the grip 16 and is selectively engageable to the magazine 60. The release button 62 is configured to be depressed to release the magazine 60 and the cannister 28 from the L-shaped housing 12.

In use, the cannister 28 is inserted into the magazine 60 and the magazine 60 then is inserted into the cavity 26. Should a user encounter a threat, the selector 44 is switched from the safe setting to either the medium setting or the high setting. The user then positions their finger on the trigger 34, whereupon the fingerprint sensor 42 authenticates the user's fingerprint to unlock the trigger 34. The user then pulls the trigger 34 and the lachrymator agent 30 is dispensed under pressure from the cannister 28 through the channel 22 toward the threat.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal defense device comprising an L-shaped housing defining a barrel portion and a grip portion, the grip portion of the housing extending from a first end of the barrel portion of the housing;

a valve positioned in the barrel portion of the housing proximate to the grip portion of the housing;

a channel extending from the valve to a second end of the barrel portion of the housing;

a cavity extending into the grip portion of the housing, such that the cavity is in fluidic communication with the valve, the grip portion of the housing being configured for selectively engaging a cannister containing a lachrymator agent inserted into the cavity, such that the cannister is removably engaged to the L-shaped housing and such that an outlet of the cannister is operationally engaged to the valve;

a trigger engaged to the L-shaped housing and being operationally engaged to the valve, wherein the trigger is configured being triggered for selectively actuating the valve, such that the lachrymator agent is dispensed under pressure from the cannister through the channel toward a target in substantial alignment with the barrel;

a battery positioned in the barrel portion of the housing;

a microprocessor positioned in the barrel portion of the housing and being operationally engaged to the battery and the valve;

a trigger lock engaged to the L-shaped housing and being operationally engaged to the microprocessor and the trigger, such that the trigger lock is positioned for selectively locking the trigger;

a fingerprint sensor engaged to the trigger being operationally engaged to the microprocessor, wherein the fingerprint sensor is configured for authenticating a fingerprint of a user, positioning the fingerprint sensor for signaling the microprocessor for actuating the trigger lock for unlocking the trigger;

an indicator coupled to the L-shaped housing and being operationally engaged to the microprocessor; and a flow sensor operationally engaged to the valve and being operationally engaged to the microprocessor, wherein the flow sensor is configured for measuring a flow of the lachrymator agent through the valve and for communicating volumetric readings to the microprocessor, positioning the microprocessor for actuating the indicator for displaying a volume of lachrymator agent remaining in the cannister.

2. The personal defense device of claim 1, further including a selector engaged to the barrel portion of the housing and being operationally engaged to the microprocessor, wherein the selector is configured for being manipulated by the user for signaling the microprocessor for enabling the fingerprint sensor and for setting the valve to allow a respective flow rate from the cannister.

3. The personal defense device of claim 1, wherein the indicator comprises a plurality of light emitting diodes positioned on opposed faces of the grip portion of the housing and opposed sides of the barrel portion of the housing.

4. The personal defense device of claim 1, further including a flashlight engaged to the barrel portion of the housing and being operationally engaged to the trigger, such that the trigger is positioned for selectively actuating the flashlight for projecting light past the second end of the barrel portion of the housing, wherein the flashlight is configured for selectively illuminating the target.

5. The personal defense device of claim 1, further including:

a magazine being configured for insertion of the cannister, the magazine being selectively insertable into the cavity, such that the magazine is removably engaged to the L-shaped housing; and a release button engaged to the grip portion of the housing and being selectively engageable to the magazine, wherein the release button is configured for being depressed for releasing the magazine and the cannister from the L-shaped housing.

6. A personal defense system comprising a cannister containing a lachrymator agent;

an L-shaped housing defining a barrel portion and a grip portion, the grip portion of the housing extending from a first end of the barrel portion of the housing;

a valve positioned in the barrel portion of the housing proximate to the grip portion of the housing;

a channel extending from the valve to a second end of the barrel portion of the housing;

a cavity extending into the grip portion of the housing, such that the cavity is in fluidic communication with the valve, the cannister being selectively insertable into the cavity, such that the cannister is removably engaged to the L-shaped housing and such that an outlet of the cannister is operationally engaged to the valve;

a trigger engaged to the L-shaped housing and being operationally engaged to the valve, wherein the trigger is configured being triggered for selectively actuating the valve, such that the lachrymator agent is dispensed under pressure from the cannister through the channel toward a target in substantial alignment with the barrel;

a battery positioned in the barrel portion of the housing;

a microprocessor positioned in the barrel portion of the housing and being operationally engaged to the battery and the valve;

a trigger lock engaged to the L-shaped housing and being operationally engaged to the microprocessor and the trigger, such that the trigger lock is positioned for selectively locking the trigger;

a fingerprint sensor engaged to the trigger being operationally engaged to the microprocessor, wherein the fingerprint sensor is configured for authenticating a fingerprint of a user, positioning the fingerprint sensor for signaling the microprocessor for actuating the trigger lock for unlocking the trigger;

an indicator coupled to the L-shaped housing and being operationally engaged to the microprocessor; and a flow sensor operationally engaged to the valve and being operationally engaged to the microprocessor, wherein the flow sensor is configured for measuring a flow of the lachrymator agent through the valve and for communicating volumetric readings to the microprocessor, positioning the microprocessor for actuating the indicator for displaying a volume of lachrymator agent remaining in the cannister.

7. The personal defense system of claim 6, further including a selector engaged to the barrel portion of the housing and being operationally engaged to the microprocessor, wherein the selector is configured for being manipulated by the user for signaling the microprocessor for enabling the fingerprint sensor and for setting the valve to allow a respective flow rate from the cannister.

8. The personal defense system of claim 6, wherein the indicator comprises a plurality of light emitting diodes positioned on opposed faces of the grip portion of the housing and opposed sides of the barrel portion of the housing.

9. The personal defense system of claim 6, further including a flashlight engaged to the barrel portion of the housing and being operationally engaged to the trigger, such that the trigger is positioned for selectively actuating the flashlight for projecting light past the second end of the barrel portion of the housing, wherein the flashlight is configured for selectively illuminating the target.

10. The personal defense system of claim 6, further including:

a magazine, the cannister being selectively insertable into the magazine, the magazine being selectively insertable into the cavity, such that the magazine is removably engaged to the L-shaped housing; and a release button engaged to the grip portion of the housing and being selectively engageable to the magazine, wherein the release button is configured for being depressed for releasing the magazine and the cannister from the L-shaped housing.

11. A personal defense device comprising an L-shaped housing defining a barrel portion and a grip portion, the grip portion of the housing extending from a first end of the barrel portion of the housing;

a valve positioned in the barrel portion of the housing proximate to the grip portion of the housing;

a channel extending from the valve to a second end of the barrel portion of the housing;

a cavity extending into the grip portion of the housing, such that the cavity is in fluidic communication with the valve, the grip being configured for selectively engaging a cannister containing a lachrymator agent inserted into the cavity, such that the cannister is removably engaged to the L-shaped housing and such that an outlet of the cannister is operationally engaged to the valve;

a trigger engaged to the L-shaped housing and being operationally engaged to the valve, wherein the trigger is configured being triggered for selectively actuating the valve, such that the lachrymator agent is dispensed under pressure from the cannister through the channel toward a target in substantial alignment with the barrel portion of the housing;

a battery positioned in the barrel portion of the housing;

a microprocessor positioned in the barrel portion of the housing and being operationally engaged to the battery and the valve;

a trigger lock engaged to the L-shaped housing and being operationally engaged to the microprocessor and the trigger, such that the trigger lock is positioned for selectively locking the trigger;

a fingerprint sensor engaged to the trigger being operationally engaged to the microprocessor, wherein the fingerprint sensor is configured for authenticating a fingerprint of a user, positioning the fingerprint sensor for signaling the microprocessor for actuating the trigger lock for unlocking the trigger;

a selector engaged to the barrel portion of the housing and being operationally engaged to the microprocessor, wherein the selector is configured for being manipulated by the user for signaling the microprocessor for enabling the fingerprint sensor and for setting the valve to allow a respective flow rate from the cannister;

an indicator coupled to the L-shaped housing and being operationally engaged to the microprocessor, the indicator comprising a plurality of light emitting diodes positioned on opposed faces of the grip portion of the housing and opposed sides of the barrel portion of the housing;

a flow sensor operationally engaged to the valve and being operationally engaged to the microprocessor, wherein the flow sensor is configured for measuring a flow of the lachrymator agent through the valve and for communicating volumetric readings to the microprocessor, positioning the microprocessor for actuating the indicator for displaying a volume of lachrymator agent remaining in the cannister;

a flashlight engaged to the barrel portion of the housing and being operationally engaged to the trigger, such that the trigger is positioned for selectively actuating the flashlight for projecting light past the second end of the barrel portion of the housing, wherein the flashlight is configured for selectively illuminating the target;

a magazine being configured for insertion of the cannister, the magazine being selectively insertable into the cavity, such that the magazine is removably engaged to the L-shaped housing; and a release button engaged to the grip portion of the housing and being selectively engageable to the magazine, wherein the release button is configured for being depressed for releasing the magazine and the cannister from the L-shaped housing.

* * * * *